United States Patent [19]

Valavaara

[11] Patent Number: 4,932,850

[45] Date of Patent: Jun. 12, 1990

[54] ROTARY DEVICE HAVING INNER AND OUTER INTERENGAGING ROTORS

[76] Inventor: Viljo K. Valavaara, #608 2797 Battleford Road, Mississauga, Ontario, Canada, L5N 2W2

[21] Appl. No.: 357,295

[22] Filed: May 26, 1989

Related U.S. Application Data

[63] Continuation-in-part of Ser. No. 167,963, Mar. 14, 1988, abandoned, which is a continuation-in-part of Ser. No. 28,093, Mar. 19, 1987, abandoned.

[51] Int. Cl.[5] ..... F03C 2/08; F04C 2/08

[52] U.S. Cl. ..... 418/171

[58] Field of Search ..... 418/166, 167, 168, 171; 73/253, 201

[56] References Cited

U.S. PATENT DOCUMENTS

| | | | |
|---|---|---|---|
| 1,277,436 | 9/1918 | Lind | 418/167 |
| 2,428,181 | 9/1947 | Sibley | 418/166 |
| 2,474,009 | 6/1949 | Molyneux | 418/166 |
| 2,490,115 | 12/1949 | Clarke | 418/166 |
| 3,910,733 | 10/1975 | Grove | 418/166 |
| 4,013,388 | 3/1977 | Stratman | 418/171 |
| 4,057,222 | 11/1977 | Lyle | 418/171 |
| 4,185,717 | 1/1980 | Ford, Jr. et al. | 418/171 |
| 4,221,552 | 9/1980 | Clark | 418/166 |
| 4,240,567 | 12/1980 | Gardner | 418/171 |
| 4,361,419 | 9/1982 | Vohringer | 418/171 |

FOREIGN PATENT DOCUMENTS

| | | | |
|---|---|---|---|
| 738296 | 10/1955 | United Kingdom | 418/168 |

OTHER PUBLICATIONS

Rotary Piston Machines—Author: Felix Wankel, Published by London Iliffe Books Limited.

*Primary Examiner*—John J. Vrablik
*Assistant Examiner*—David L. Cavanaugh

[57] ABSTRACT

A rotary device having an outer rotor with an internal cavity, an inner rotor within the outer rotor, which is offset with respect to the outer rotor with spacing between the rotors varying from a minimum to a maximum, an inlet port and an outlet port, a plurality of arms on one rotor extending towards the other rotor, an equal number of recesses on the other rotor, respective recesses receiving respective arms the recesses and arms being so shaped that upon rotation of the rotors in unison any one arm may move inwardly and outwardly of its respective recess with at least one seal between the rotors being maintained over an angular region of minimum spacing and, at least two seals being maintained over an angular region of maximum spacing.

6 Claims, 7 Drawing Sheets

ROTARY DEVICE HAVING INNER AND OUTER INTERENGAGING ROTORS

This application is a Continuation-in-Part of application Ser. No. 167,963 (now abandoned), Rotary Device, filed March 14, 1988, inventor William K. Valavaara, which was in turn a Continuation-in-Part of application Ser. No. 028,093, filed March 19, 1987, (now abandoned), inventor William K. Valavaara.

FIELD OF THE INVENTION

The invention relates to a positive displacement rotary device, such as a motor or pump, for use generally with fluids, and in particular with liquids.

BACKGROUND OF THE INVENTION

Rotary devices for use as pumps or motors usually suffer from certain basic design limitations, namely that they operate with maximum mechanical efficiency only over a relatively narrow range. That is to say, the output of a device is at a maximum over a relatively narrow range of rotational speeds. Above such range, the output of the device will drop significantly. Numerous proposals have been made to produce such rotary devices having a wider efficient working range, the usual idea behind such attempts being to employ a rotary type device, which provides positive displacement of the fluid material. However, the majority of positive displacement rotary devices suffer from other disadvantages. Some of them are excessively complex, resulting in great expense and high frequency of repair. Others suffer from problems of sealing working surfaces, and in others considerable wear is caused by friction. Still others suffer from difficulties in attempting to balance eccentric forces. Valving and porting of such devices is also a common problem.

A wide variety of rotary devices have been described in Rotary Piston Machines, by Felix Wankel published by London Iliffe Books.

In rotary devices of the gear type a common problem is the trapping and pressurization of liquid between the gears, resulting in noisy operation and low mechanical efficiency, particularly at high rotative speeds. Existing methods to solve this problem in gear-type devices are complex and expensive.

In internal gear-type rotary devices (commonly known as "gerotors"), there is an inner and an outer rotor. There are also teeth on the internal surface of the outer rotor adapted to mesh with the teeth of the inner rotor. Adjacent teeth on the same rotor define recesses therebetween. In known gerotors, there are one or more teeth more on the outer rotor than there are on the inner rotor. Both rotors rotate. However, because of the different number of teeth on each rotor, one rotates faster than the other, thus there is relative rotation between the two rotors. Each tooth translates from one recess into another adjacent recess. Fluid may be trapped between a tooth and the bottom of its associated recess.

It will of course be readily appreciated that the advantages obtained by providing an efficient rotary device using a positive displacement principle are very great. Theoretically, the rotational speeds of an efficient rotary device can be allowed to reach very high values without damage. Similarly, using positive displacement principles, usable power outputs and pressures can be obtained at relatively low pressures and rotational speeds. Thus, for example, such a device can theoretically be used both for the relatively low pressure, high flow rate application of a water wheel, and may, with various engineering changes, be used for the pumping of liquids at very high shaft speeds.

As mentioned, numerous attempts have been made to design rotary devices to take advantage of such wide-ranging applications. Some of such attempts have depended on a central rotor with movable vanes rotating in a chamber. Others have employed two rotors rotating in opposite directions with interlocking vanes. Still others have attempted to solve the problems by using eccentrically-shaped rotors rotating in a specially shaped chamber. However, all of these proposals suffer from one or other of the disadvantages noted above.

Where such devices are to be used in conjunction with hydraulic fluids such as oil, then the devices are self-lubricating. However, where such devices are to be used with other liquids particularly for example water, then it becomes necessary to insure that there is no direct metal-to-metal rubbing contact. In devices previously proposed, such metal-to-metal rubbing contact is virtually impossible to prevent. Consequently, such devices are unsuitable for operating with non-lubricating liquids, such as water, or other non-lubricating liquids.

BRIEF SUMMARY OF THE INVENTION

The present invention seeks to overcome the foregoing disadvantages by the provision of a rotary device comprising an outer rotor defining a first axis of rotation, an internal cavity and axial ends, an inner rotor mounted within said cavity for co-rotation with the outer rotor in the same direction, said inner rotor defining a second axis of rotation, offset with respect to said first axis whereby to define a spacing between said rotors varying from a minimum to a maximum at respective positions on opposite sides of said rotors, a transverse axis between said positions defining an inlet side of said rotors on one side of said axis and an outlet side of said rotors on the other side of said axis, enclosure means at least partially enclosing said rotors, said enclosure means defining inlet port means on said inlet side of said transverse axis and outlet port means on said outlet side of said transverse axis, and further defining a first sealing wall portion being located around said position of minimum spacing and a second sealing wall portion being located around said position to maximum spacing, a plurality of arms on one of said rotors extending towards the other said rotor, and, an equal number of recesses on said other rotor, respective recesses receiving respective arms therein, said recesses and arms being shaped whereby upon rotation of said rotors in unison any one arm may move inwardly and outwardly of its respective recess, and at least two seals between said rotors being maintained over an angular region, at said point of minimum spacing and two seals being maintained over another angular region at said point of maximum spacing.

A significant feature of the invention is the fact that because the two rotors co-rotate together in unison, but on different rotational axes, the only relative motion between the rotors is the sweeping action of an arm about its recess. Consequently, there is little or no rubbing friction of the type requiring complex lubrication. With proper choice of materials for the rotary device according to the invention, the working liquid may itself provide all necessary lubrication. Contact between the arms and the surfaces of the recesses can be minimized so as to reduce lubrication requirements. Rubbing movement between rotors may be further reduced by the use of synchronizing gears driving both rotors simultaneously. In addition, since both rotors operate on axes which are central of themselves, although the two axes are spaced apart from one another, there are no orbital or eccentric centrifugal forces which are difficult to balance out. In addition, there are only two moving parts, namely the two rotors, consequently manufacture and assembly are simplified to a degree not found in almost any other such rotary device.

The size of the rotary device according to the invention is smaller than standard rotary devices capable of similar mass flow rates, allowing for savings in material, weight and cost. Conversely, for devices of the same size, a device according to the invention may have a greater output.

A further significant feature of the invention is that the arms and recesses are contoured so as to define pockets between the arms and the surface of the recesses which pockets hold and trap a small amount of liquid at certain points in the cycle. Such trapped liquid acts as a hydraulic cushion between the rotors to further reduce rubbing friction.

Metered passage ways may be formed at key points to allow such trapped liquid to flow at a pre-determined restricted flow rate, so as to avoid pressuring of such trapped liquid which might cause problems.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Referring to FIGS. 1 to 4, one illustrated embodiment of the invention will be seen to comprise a rear housing plate 10 and a front housing plate 12, which are shown schematically, and merely represent any form of supporting structure which may or may not be a complete housing, which act as supports.

Figure 2:
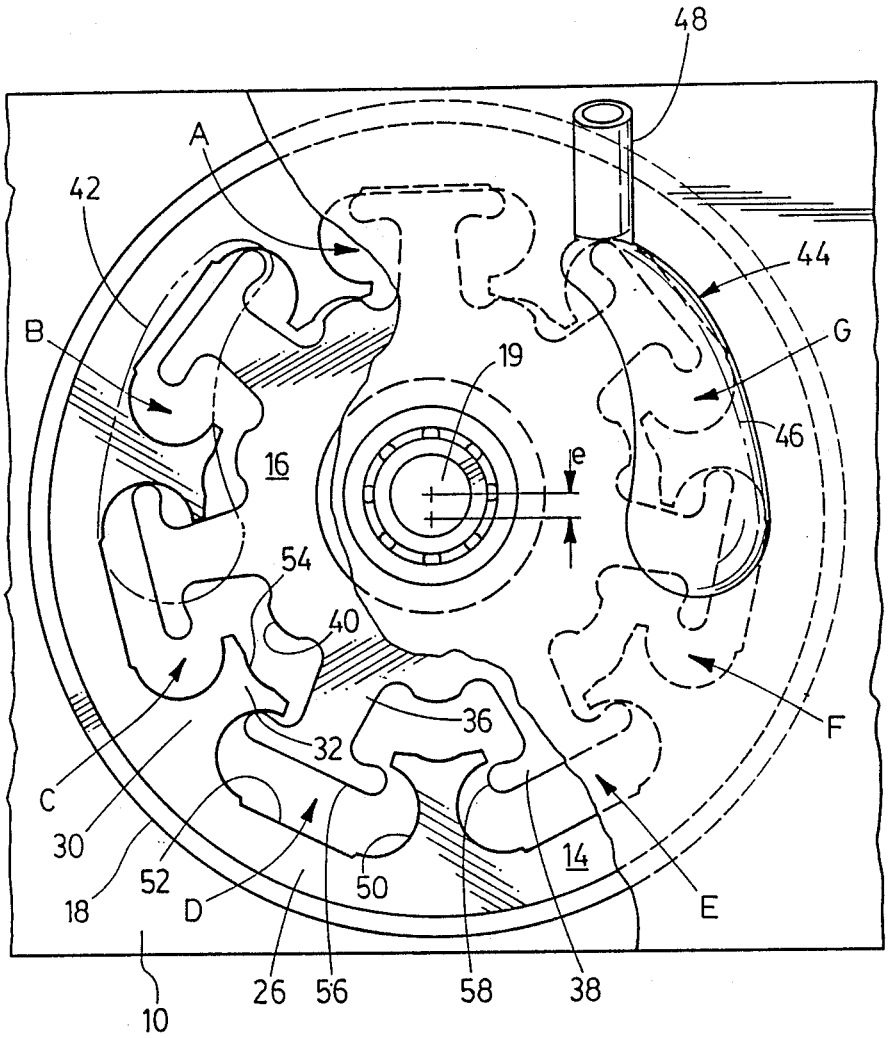
FIG. 2 is a schematic plan view of a rotary device according to the invention.
Figure 3:
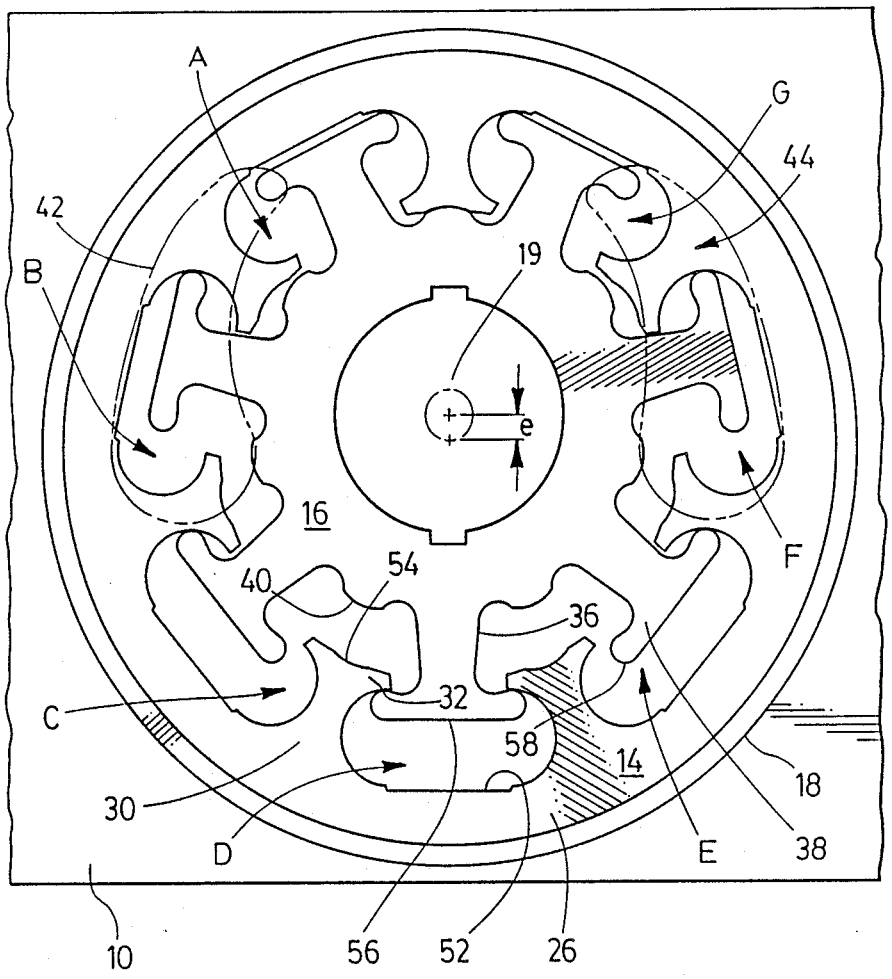
FIG. 3 is a schematic plan view of the device of FIG. 2 in a different angular position.

The outer rotor 14 is rotatably mounted on rear housing plate 10 and the inner rotor 16 is rotatably mounted on the front plate 12. The outer rotor 14 is suitably rotatably mounted by means of a bearing ring 18, on rear mounting plate 10. Inner rotor 16 is rotatably mounted by means of integral boss 19, and a bearing 20 mounted in front plate 12. As best shown in FIGS. 2 and 3, the axes of rotation of rotors 14 and 16 are offset with respect to one another by a distance "e".

Both rotors 14 and 16 are circular in plan, and are symmetrical about their respective centres, thereby greatly simplifying manufacture and balancing of the rotors.

Outer rotor 14 is provided with a plurality of recesses 22, which in the embodiment illustrated in FIGS. 1 to 5 comprise an elongated generally oval shape in cross-section. Each of recesses 22 communicate with the interior of rotor 14 by means of an opening 24.

Outer rotor 14 is shown in this embodiment of the invention as comprising a cylindrical outer wall 26, and a generally circular flat rear wall 28, walls 26 and 28 thereby defining a generally circular open interior cavity, within which inner rotor 16 is located.

Any means such as the bearing ring 18 may be provided for rotatably supporting outer rotor 14 for rotation about a symmetrical axis as described above.

It will, of course, be appreciated that the illustration of walls 26 and 28, and bearing ring 18, is purely schematic. Rotor 14 could equally well be mounted for rotation on a suitable boss running in a bearing for example (not shown), or suported in any suitable way, and wall 28 could be dispensed with or formed separately.

Within the interior of outer rotor 14, a plurality of integral abutment members 30 are provided, rooted on the inner surface of wall 26 and extending inwardly in a radial manner. The abutment members 30 are shaped to define the recesses 22.

Abutment members 30 terminate, in this embodiment, in sealing bodies 32 having end surfaces **33*a* and 33*b*** for purposes to be described.

Inner rotor 16 is a generally star-shaped body having a central core 34, and a plurality of radial arms 36.

The number of arms 36 corresponds with the number of recesses 22 in outer rotor 14. Each of the arms 36 terminates in a generally Tee-shaped head 38. Between the arms 36, there are raised sealing ridges 40.

Located in the front housing plate 12, there are, in this embodiment, an inlet opening 42 and an outlet opening 44. The openings 42 and 44 are generally arcuately shaped or "kidney" shaped. The designation of ports 42 and 44 as inlet and outlet is purely by way of explanation, and without limitation.

Port covers 46 cover the two ports 42 and 44, and the covers 46, in turn, are provided with pipes 48, by means of which the device may be connected in a hydraulic circuit.

Boss 19 and bearing 20 of inner rotor 16 are on an axis which is displaced or offset by the predetermined distance "e" from the axis of bearing 18 of outer rotor 14.

Because the axes of rotors 14 and 16 are offset, a spacing is defined between the rotors which varies from a minimum to a maximum at respective positions on opposite sides of the inner rotor. In the illustrated embodiments, the minimum spacing position is at the twelve o'clock position. The maximum spacing position is at the six o'clock position. Such positions of minimum and maximum spacing define a notional dividing line or axis. Such line defines and separates an inlet side of the rotary device on one side of the line and an outlet side of the rotary device on the other side.

The rotary device, in general terms, can be used either as a pumping device or as a motor, as such devices are generally known in the trade.

For the purposes of this discussion, it will be assumed that the rotary device illustrated is being used as an hydraulic motor, that is to say, a device into which hydraulic fluid is pumped under pressure, and which is then used to convert the flow of such hydraulic fluid into rotary movement.

Ports 42 and 44 do not communicate directly. Enclosure means around the cavity prevent such communication except through the rotary device. In the embodiment of FIGS. 1 to 4, such enclosure comprises front wall 12 and rear wall 28 of rotor 14. The front support wall 12 defines a sector-shaped upper barrier portion 12*a* centered at the twelve o'clock position of FIGS. 2 and 3 between ports 42 and 44. Support wall 12 also defines a sector-shaped lower barrier portion 12*b* centered at the six o'clock position of FIGS. 2 and 3 between ports 42 and 44.

Ports 42 and 44 are of such length as to register with a plurality of recesses 22 simultaneously. In the configurations illustrated, such ports register with a maximum of three recesses 22 simultaneously.

As best shown in FIGS. 2, 3, 4 and 5, this embodiment of the invention provides recesses 22 and arms 36 with heads 38, which are of predetermined complementary shapes so as to effectively provide a seal at many points around the rotors. There are at least two seals around top dead center, the point of minimum spacing, and another two seals are maintained on either side of bottom dead center, the point of maximum spacing. Top dead center, is the point of minimum spacing, is shown enlarged in FIG. 4, corresponding to the FIG. 2 position of the rotors. Bottom dead center, the point of maximum spacing, is shown enlarged in FIG. 5, corresponding to the FIG. 3 position of the rotors.

It will be understood that FIGS. 2 and 3 illustrate the device in two different rotational positions. Thus, FIG. 3 is rotated relative to FIG. 2 an arcuate distance equal to one-half the angular extent or length of the recess 22.

Figure 4:
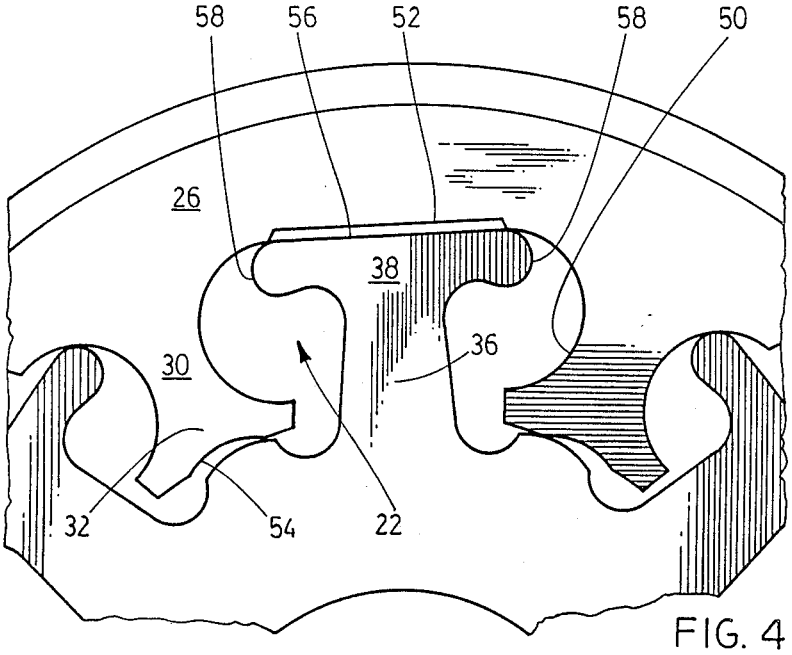
FIG. 4 is an enlarged partial view of the rotary device of FIGS. 2 and 3 at the point of minimum spacing.
Figure 5:
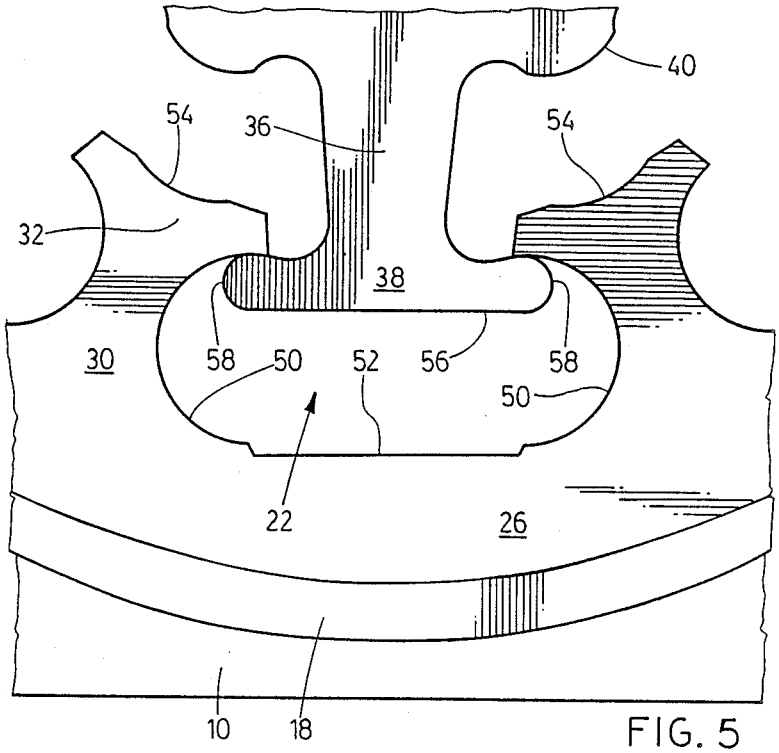
FIG. 5 is an enlarged partial view of the rotary device, at the point of maximum spacing.

The recesses 22, and their respective arms 36 and heads 38, are provided with complementary mating surfaces, best shown in FIGS. 4 and 5. Thus, each recess 22 defines two semi-cylindrical end walls 50, and a shallow channel-like groove 52.

Each of the sealing bodies 32 has a shallow arcuate groove 54 for reception of respective ridges 40.

Each of the T-shaped heads 38 on arms 36 has a planar outwardly directed surface 56, and semi-cylindrical radiused end surfaces 58.

The radiusing of the surfaces 50 and 58, and the relative dimensions of the arms 36, heads 38, and recesses 22, are dependent upon the offset "e" between the two axes of the two rotors.

In the FIG. 2 and 4 position, the T-shaped heads 38 at top dead center seal by contacting (at both ends simultaneously) the two semi-cylindrical surfaces of a single recess 22 (making two seals in this position).

In the FIG. 3 position two T-shaped heads 38 seal in two adjacent recesses, and a third seal is made by a groove 54 and a rib 40, making three seals in this position.

At bottom dead center in the FIG. 3 and 5 position, a T-shaped head seals at both ends simultaneously with the semi-cylindrical surfaces of a single recess making two seals in this position.

In the FIG. 2 position, two T-shaped heads seal in two adjacent recesses, on either side of bottom dead center again making two seals in this position.

The operation of the invention is best understood with respect to FIGS. 2 and 3.

For the purposes of this discussion, the spacing between any two arms 36 of the inner rotor 16 and the wall 26 of outer rotor 14, forms a chamber of the device.

For the purposes of this discussion, such chambers are shown in FIGS. 2 and 3 as A, B, C, D, E, F, and G, respectively.

The inlet port 42 is located so that it extends approximately from the eleven o'clock to the eight o'clock position; and outlet port 44 extends approximately from the four o'clock to the one o'clock position. The precise extent of such ports will depend upon the engineering of the particular rotary device.

In order to minimize the trapping and consequent pressurization of fluid at top dead center and to ensure that there is a separation between the two ports, inlet and outlet ports 42 and 44 are angularly spaced apart about the twelve o'clock position by an amount which in this embodiment corresponds to at least about the maximum angular extent of a chamber or recess centered at the twelve o'clock position (see FIG. 2). Upper barrier portion 12*a* separates one port from the other, within this angular space.

In order to separate the inlet side from the outlet side at bottom dead center, inlet and outlet ports 42 and 44 are angularly spaced apart about the six o'clock position in this embodiment by an amount at least corresponding to the maximum angular extent of three chambers when one chamber is centered at the six o'clock position.

Lower barrier portion 12*b* prevents flow from one side to the other within this angular region. Such spacing of the inlet and outer ports 42 and 44 ensures that there will always be two seals between such ports at the transition from inlet to outlet and either two or three seals at the transition from outlet to inlet. Such seals ensure that fluid cannot flow directly from one side of the rotors to the other.

The arms 36 and recesses from about eight o'clock clockwise to about four o'clock are so arranged and dimensioned that the ends 58 of heads 38 slide around the semi-cylindrical surfaces of their associated recesses 50 so as to effectively seal the same, so that a significant amount of fluid may not pass around arms 36 from one chamber to another.

As shown in FIG. 2, between the eight o'clock and four o'clock positions, the seal transfers from one end 58 of a head 38 to the other end 58. Between such positions there may be passage of fluid from one chamber to another at, or close to, the six o'clock position (FIG. 2).

A shallow groove 52 is formed in each recess so as to provide an enlarged fluid space, to reduce trapping of fluid at top dead centre. It will be noted that this fluid space is effective only at the twelve o'clock position as illustrated in FIG. 2, that is to say, where the recess 22 is located at twelve o'clock.

Where, however, the recesses 22 are located on either side of twelve o'clock (FIG. 3), the space between the planar surfaces of the heads 38 and their associated recesses have already been opened up.

Effective fluid seals are maintained on either side of twelve o'clock by heads 38.

In order to further ensure effective sealing of one recess from another at the twelve o'clock position, the sealing bodies 32 are provided with the shallow grooves 54, which are shaped to complement the profiles of the ridges 40 on the inner rotor.

These surfaces are brought into contact only over a narrow arc extending either side of the twelve o'clock position, as illustrated in FIGS. 2 and 3.

Throughout the rest of the rotational cycle of the device, the bodies 32 are out of contact with the ridges 40.

It will thus be appreciated that for a moment on either side of the twelve o'clock position (FIG. 4) where the seal transfer from one end 58 of the head 38 to the other, the groove 54 and the ridge 40 are brought momentarily in sealing contact.

This particular feature permits the device to be run at high rotational speeds generating high fluid pressures.

In operation where the device is used as a hydraulic motor, then pressurized hydraulic fluid is supplied to the inlet port 42, and this will then fill the chambers registering with the inlet port at that moment.

This will procure rotation of both outer and inner rotors in an anti-clockwise direction, and as each chamber progressively increases in size, while registering with the inlet port, more and more hydraulic fluid will fill each of the chambers.

As each of the chambers passes out of communication with the inlet port, other chambers will be in registration with the inlet port, and so rotation will continue.

Since the volume of the chambers continues to increase until the six o'clock position, the effect of the pressurized fluid within the chambers will be to continue to procure rotation.

As the chambers pass the six o'clock position, their volume reduces and they will commence registering with the outlet port 44. The hydraulic fluid will thus be ejected, having given up its pressure, to cause rotation of the device.

It may be desirable to have a gear system between the two rotors (not shown) in order to maintain precise accurate angular spacing between them, although in practice this has not been found to be necessary.

When the device is being used as a pump, rotary power is supplied to one or other of the two rotors.

In this case, a low pressure fluid is supplied to the inlet port, and the chambers will progressively fill as before. As the rotation continues as a result of a rotary force from some other motor (not shown), fluid will be transferred to the outlet port, and will be progressively ejected, thereby providing a continuous rotary pumping action.

Figure 1:
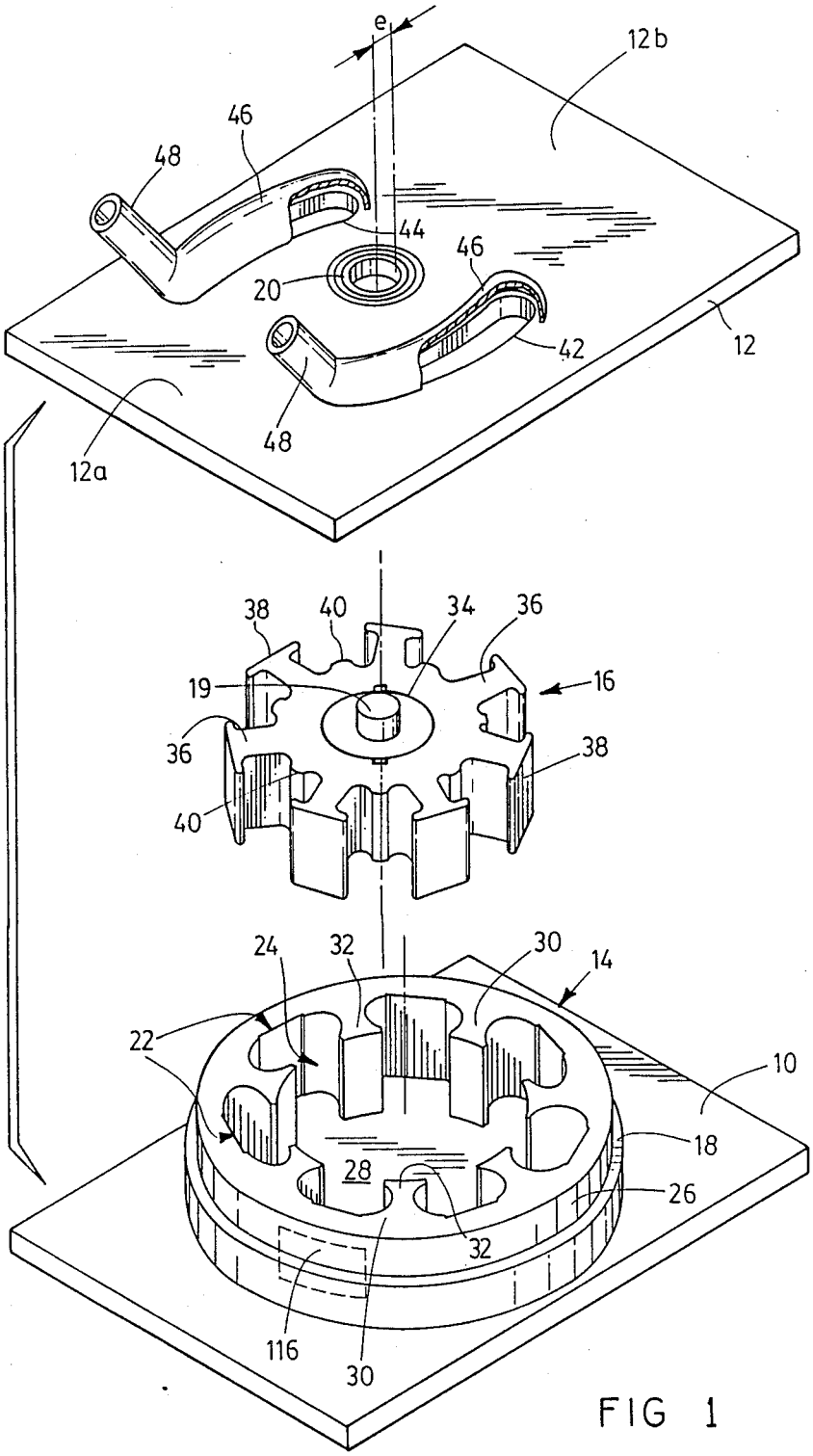
FIG. 1 is an exploded perspective illustration of a rotary device according to the invention.

In the embodiment of FIG. 1, the inlet and outlet ports are shown both located on one side of the device.

It will, of course, be appreciated that this is in no way limiting on the invention. The ports could equally well be supplied on either side or on either edge, or in various other locations.

Figure 6:
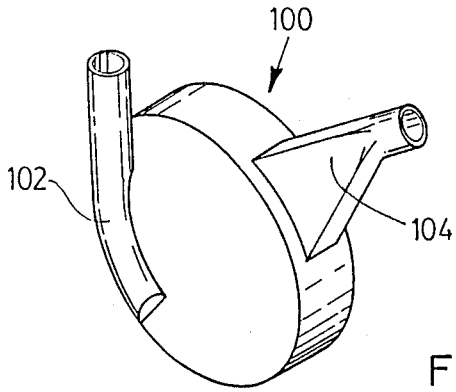
FIG. 6 is a schematic illustration of a second embodiment of a rotary device according to the invention.

Thus, as shown schematically in FIG. 6, a modified device 100 may have inlet port 102 located on one side, and an outlet port 104 located around the periphery.

Figure 7:
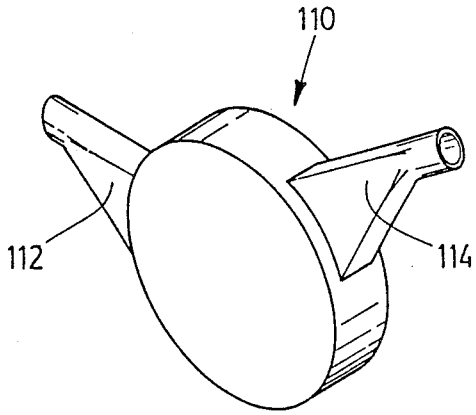
FIG. 7 is a schematic illustration of a further embodiment.

A further modified device 110 is shown in FIG. 7 in which both the inlet port 112 and the outlet port 114 are located around the periphery.

In this case, the outer rotor may be provided with openings in the side wall 26 registering with each of the recesses 22, whereby fluid may flow into and out of such recesses through respective openings in the side wall 26 of outer rotor 14.

Such openings are known per se and are omitted for the sake of clarity.

Figure 8:
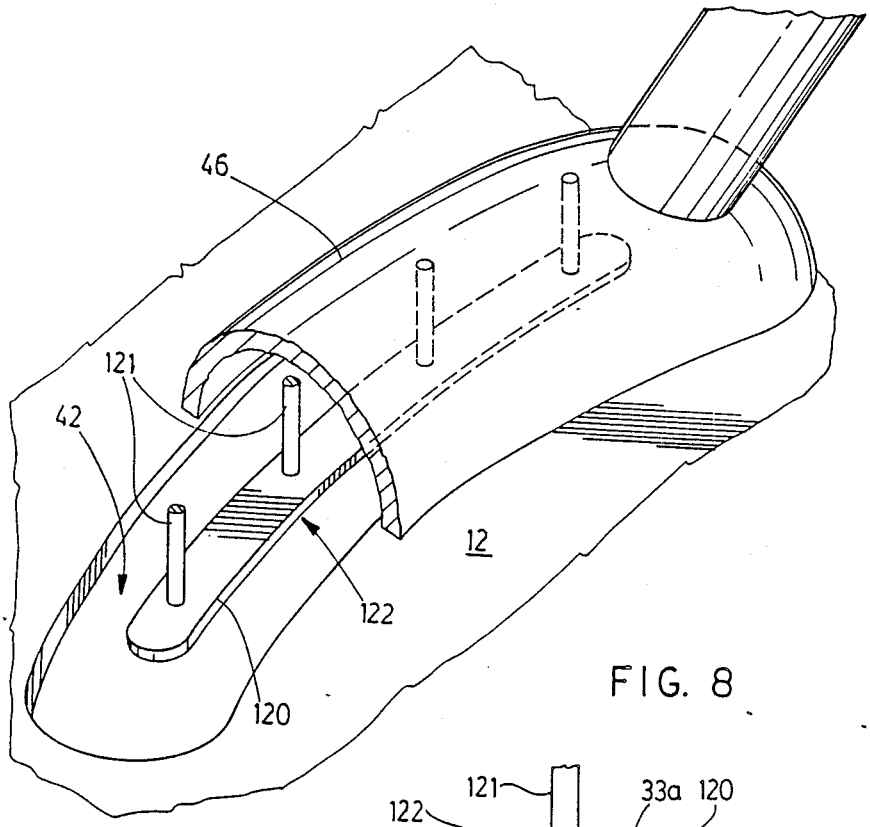
FIG. 8 is a schematic perspective illustration of a further embodiment of the invention.
Figure 10:
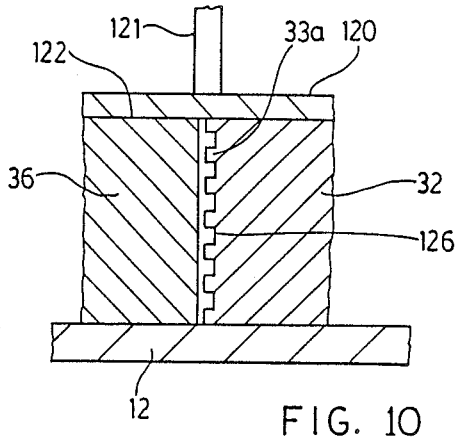
FIG. 10 is a section along the line 10—10 of FIG. 9.
Figure 9:
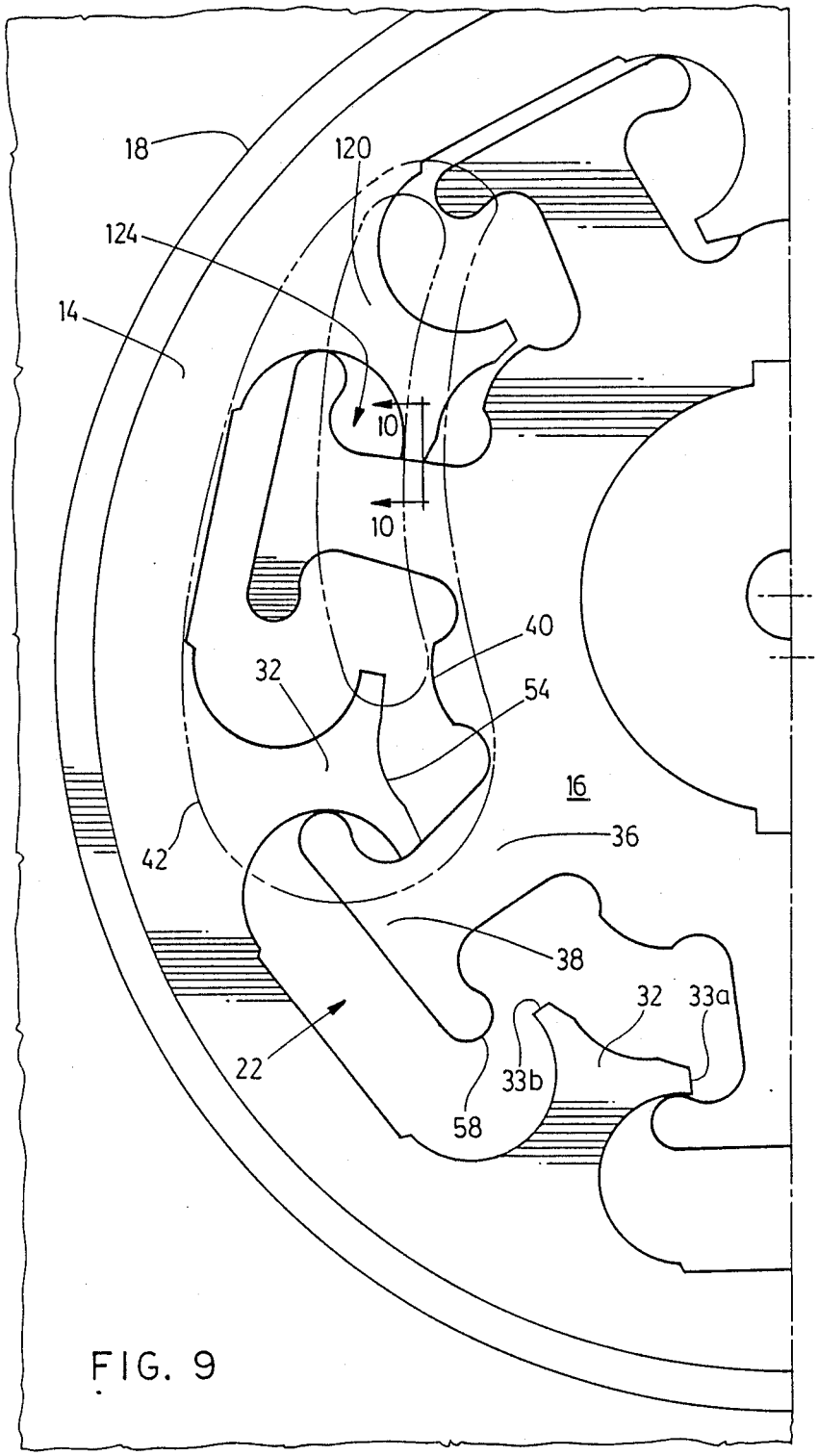
FIG. 9 is a schematic plan view of a portion of the device showing the trapping of liquid over a portion of its cycle.

In accordance with a further embodiment of the invention as illustrated in FIGS. 8, 9, and 10, provision may be made for an hydraulic cushion between the inner and outer rotor, so as to effectively prevent metal-to-metal rubbing contact. This is particularly suitable for use where non-lubricating liquids are to be used, such as for example water.

In this embodiment of the invention, a mask wall 120 is located, supported by legs 121 within the cover portion 46 of inlet port 42. Mask wall 120 defines a mask contact surface 122, which is adapted to lie coplanar with the interior surface of the front wall 12. It thus contacts the surfaces of the inner and outer rotor. Mask wall 120 is shaped in a generally kidney shape, as indicated in FIG. 8 and in phantom in FIG. 9. It defines a pre-determined mask area, adapted to register with a portion only of the arms 36 and T-shaped heads 38 of inner rotor 12, leaving the remainder of the inlet port 42 free for passage of liquid therethrough.

As best shown in FIG. 9, the T-shaped heads 38 and the arms 36, together with the sealing members 32 and surfaces **33*a*, define a cushion chamber indicated generally as 124, along the leading side of the arms 36, and the interior surfaces of the heads 38. Liquid within this cushion chamber, which in the absence of the mask plate 120, would be free to flow into the inlet port 42**, is in fact trapped, and provides an hydraulic cushion between the two rotors.

It will be noted from FIG. 9, that the chamber 124 will progressively diminish in volume as the two rotors rotate. However, the liquid cannot escape due to the effect of the mask plate 120.

In order to permit a progressive and regulated release of this liquid therefore, metered channels 126 are formed in end surfaces **33*a* of sealing bodies 32 (FIG. 10). It will thus be appreciated that depending upon the engineering of the particular rotary device, and the sizing of the channels 126**, the trapped liquid can be progressively released at a controlled rate thereby providing the desired hydraulic cushion.

While the channels 126 are shown formed on the sealing bodies 32, it will be appreciated that they could equally well be formed on the other member or on both of such members, if desired.

Figure 11:
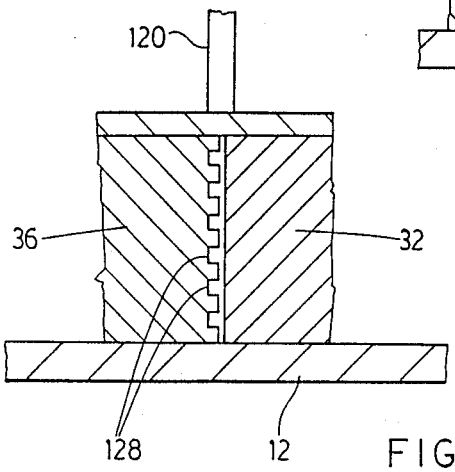
FIG. 11 is a section, corresponding to FIG. 10, showing an alternate embodiment.

For example, as shown in FIG. 11, the arms 36 may be formed with channels 128, and the channels 126 omitted from the sealing body 32.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A rotary device comprising:

an outer rotor defining a first axis of rotation, an internal cavity and axial ends;

an inner rotor mounted within said cavity for co-rotation with the outer rotor in the same direction, said inner rotor defining a second axis of rotation, being offset with respect to said first axis whereby to define a spacing between said rotors varying from a minimum to a maximum at respective positions on opposite sides of said rotors, a transverse axis between said positions defining an inlet side of said rotors on one side of said axis and an outlet side of said rotors, on the other side of said axis;

enclosure means at least partially enclosing said rotors, said enclosure means defining inlet port means on said inlet side of said transverse axis and outlet port means on said outlet side of said transverse axis, a first sealing wall portion located around said position of minimum spacing and a second sealing wall portion located around said position of maximum spacing;

a plurality of arms on said inner rotor extending towards said outer rotor;

an equal number of recesses in said outer rotor, respective recesses receiving respective arms therein, said recesses and arms being shaped whereby upon rotation of said rotors in unison any one arm may move inwardly and outwardly of its respective recess, said recesses defining generally semi-cylindrical sealing surfaces at either end;

grooves formed in said outer rotor between said respective semi-cylindrical sealing surfaces of said recesses;

generally T-shaped heads on said arms, said T-shaped heads defining opposite ends having semi-cylindrical sealing surfaces whereby each said head is adapted to seal with both said semi-cylindrical sealing surfaces of a said recess simultaneously, when they are both at said point of minimum spacing, and said T-shaped heads further defining outwardly directed planar surfaces extending between said semi-cylindrical sealing surfaces at said opposite ends whereby, when a said recess and its respective T-shaped head are at said point of minimum spacing, one end of said recess is sealed from the other end of said recess, by said arms and said T-shaped head, and, when a said recess and its respective T-shaped head are at said point of maximum spacing, each said head is adapted to seal with both said semi-cylindrical sealing surfaces of said recess simultaneously, sealing said recess from each adjacent recess;

a plurality of sealing ridges on said inner rotor, each said ridge being located between adjacent said arms;

an equal number of sealing bodies on the outer rotor, each said sealing body being located between adjacent said recesses;

said sealing bodies and said sealing ridges being adapted to come into sealing engagement over a minor arc adjacent the position of minimum spacing between said rotors, whereby at least one seal is maintained between said rotors over an angular region within said first sealing wall portion; and, said semi-cylindrical surfaces of said recesses, and said T-shaped heads, maintaining seals over an angular region within said second sealing wall portion.

2. A rotary device as claimed in claim 1 including housing means enclosing said outer and inner rotors and wherein at least one of said inlet and outlet port means are located around the periphery of said housing means.

3. A rotary device as claimed in claim 1 including mask plate mean located within said inlet port means, and adapted to register with a predetermined portion of said inner and outer rotors, whereby to entrap a portion of liquid between portions of said inner and outer rotors when the same register with said mask plate means, and, means for permitting a metered release of said entrapped liquid, as said rotors rotate, whereby to provide an hydraulic cushion.

4. A rotary device as claimed in claim 3 wherein said mask plate means registers with portions of said arms and said T-shaped heads, and portion of said sealing bodies, whereby to create a cushion cavity between said arms and said T-shaped heads and said sealing bodies, and including restricted opening means whereby to permit controlled release of liquid therefrom.

5. A rotary device as claimed in claim 4 wherein said restricted opening means is formed in said sealing bodies.

6. A rotary device as claimed in claim 4 wherein said restricted opening means is formed in said arms.

* * * * *